US010477978B1

(12) United States Patent
Youngblood et al.

(10) Patent No.: US 10,477,978 B1
(45) **Date of Patent: *Nov. 19, 2019**

(54) MULTI-ZONE TEMPERATURE MODULATION SYSTEM FOR BED OR BLANKET

(71) Applicant: Youngblood IP Holdings, LLC, Mooresville, NC (US)

(72) Inventors: Todd Richard Youngblood, Mooresville, NC (US); Tara Lynn Youngblood, Mooresville, NC (US)

(73) Assignee: YOUNGBLOOD IP HOLDINGS, LLC, Mooresville, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/961,134

(22) Filed: Apr. 24, 2018

Related U.S. Application Data

(63) Continuation of application No. 15/482,148, filed on Apr. 7, 2017, which is a continuation of application No. 12/203,241, filed on Sep. 3, 2008, now abandoned.

(60) Provisional application No. 61/084,995, filed on Jul. 30, 2008.

(51) Int. Cl.

| | |
|---|---|
| ***A47C 21/04*** | (2006.01) |
| ***F25B 21/04*** | (2006.01) |
| ***A47G 9/02*** | (2006.01) |

(52) U.S. Cl.
CPC ..... *A47C 21/04* (2013.01); *A47G 9/0215* (2013.01); *F25B 21/04* (2013.01); *A47C 21/042* (2013.01); *A47C 21/044* (2013.01)

(58) Field of Classification Search
CPC ..... A47C 21/04; A47C 21/042; A47C 21/044; A47C 21/046; A47C 21/048; A47G 9/0215; F25B 21/04; A61G 2203/46; A61G 2210/90; A61G 2210/70
See application file for complete search history.

(56) References Cited

U.S. PATENT DOCUMENTS

| | | | | |
|---|---|---|---|---|
| 2,504,308 A * | 4/1950 | Donkle, Jr. | ..... | A47G 9/0215 165/46 |
| 2,753,435 A | 7/1956 | Ivar | | |
| 3,867,939 A * | 2/1975 | Moore | ..... | A61F 7/02 604/291 |
| 4,114,620 A * | 9/1978 | Moore | ..... | A61F 7/02 5/421 |

(Continued)

FOREIGN PATENT DOCUMENTS

| | | |
|---|---|---|
| GB | 2101966 | 1/1983 |

*Primary Examiner* — Nicholas F Polito
*Assistant Examiner* — Morgan J McClure
(74) *Attorney, Agent, or Firm* — NEO IP

(57) ABSTRACT

A temperature modulation system for a bed, blanket, or other furniture includes a fluid for moderating temperature change, a number of conduit circuits for directing the fluid through respective zones, a control unit including a thermoelectric device for modulating temperature of the fluid, and a pump. Each of the conduit circuits selectively and independently directs fluid through its respective zone in order to produce a temperature within the zone that is independent of the temperature outside the zone. The system also includes an arrangement of one or more zones in an arrangement in which the control unit is programmed to vary the zone temperature over time according to a schedule.

13 Claims, 6 Drawing Sheets

(56) References Cited

U.S. PATENT DOCUMENTS 4,132,262 A 1/1979 Wibell
4,777,802 A 10/1988 Feher
5,033,136 A * 7/1991 Elkins ..... A47C 21/048 5/421
5,329,096 A 7/1994 Suematsu
5,448,788 A 9/1995 Wu
5,555,579 A 9/1996 Wu
5,568,659 A 10/1996 Fogel
5,669,094 A 9/1997 Swanson
5,697,963 A 12/1997 Augustine
5,701,621 A 12/1997 Landi et al.
5,800,480 A 9/1998 Augustine et al.
5,948,303 A * 9/1999 Larson ..... G05D 23/1905 126/205
6,006,524 A 12/1999 Park
6,163,907 A 12/2000 Larson
6,539,725 B2 4/2003 Bell
6,581,224 B2 6/2003 Yoon
6,582,456 B1 * 6/2003 Hand ..... A61F 7/007 219/212
6,606,754 B1 * 8/2003 Flick ..... A47C 21/044 5/421
6,768,086 B2 7/2004 Sullivan et al.
6,826,789 B1 12/2004 Choi
6,855,158 B2 2/2005 Stolpmann
6,859,967 B2 3/2005 Harrison et al.
6,871,365 B2 3/2005 Flick et al.
6,934,985 B2 8/2005 Sanders
6,945,987 B2 9/2005 Beard et al.
6,957,454 B1 10/2005 Newton
7,084,774 B2 8/2006 Martinez
7,111,465 B2 9/2006 Bell
7,176,419 B2 2/2007 Ellis et al.
7,226,471 B2 6/2007 Heaton et al.
7,331,184 B2 2/2008 Lee
7,353,554 B2 4/2008 Wang
7,877,827 B2 * 2/2011 Marquette ..... A47C 21/044 5/423
2003/0019044 A1 * 1/2003 Larsson ..... A47C 21/044 5/724
2003/0046762 A1 * 3/2003 Stolpmann ..... A61F 7/00 5/421
2004/0187216 A1 9/2004 Lin
2005/0278863 A1 * 12/2005 Bahash ..... A01K 1/0353 5/726
2006/0048520 A1 3/2006 Huang et al.
2007/0277313 A1 * 12/2007 Terech ..... A47C 7/74 5/421
2008/0127423 A1 * 6/2008 Gammons ..... A47C 27/082 5/713
2010/0287701 A1 11/2010 Frias

* cited by examiner

MULTI-ZONE TEMPERATURE MODULATION SYSTEM FOR BED OR BLANKET

CROSS-REFERENCE TO RELATED APPLICATIONS

This application is a continuation of U.S. application Ser. No. 15/482,148, filed Apr. 7, 2017, which is a continuation of U.S. application Ser. No. 12/203,241, filed Sep. 3, 2008, which claims the benefit of U.S. Provisional Patent Application No. 61/084,995, filed Jul. 30, 2008, each of which is incorporated herein by reference.

FIELD OF THE INVENTION

The present invention relates generally to heating and cooling systems for bed mattresses, blankets, and other furniture, and more generally to a multi-zone temperature modulation system whereby each zone may be selectively and independently heated or cooled to a target temperature.

BACKGROUND OF THE INVENTION

It is desirable to control the temperature of a bed or other piece of furniture that supports a person, such as when sleeping. Such control has therapeutic value in treating symptoms of menopause or conditions of hypothermia or hyperthermia, particularly when those conditions manifest themselves over a long period of time. Therapeutic value may also be seen for individuals who have circulatory disorders, sleep disorders, and other conditions that may be improved by increasing the comfort felt during sleep. Such control can be desirable even outside the therapeutic value of cooling or heating a mattress, simply to match the personal comfort preferences of healthy individuals, or to provide localized control when a more general control, such as heating or air conditioning of a sleeping space, is unavailable or when adjustments to the general control would cause others discomfort or would be inefficient from an energy consumption perspective.

Various methods of temperature control are known, including such classic systems as electric blankets or heating pads, as well as more recent developments that involve the circulation of a heated or cooled fluid through a mattress, such as directing air through the chambers of an air mattress or directing air or a fluid through a tube that is embedded within a mattress or a mattress topper. The more advanced of these systems utilize a heat source or sink (i.e., cooling source) to heat or cool a reservoir of fluid to a selected target temperature and pump the heated or cooled fluid through the available conduit, relying on principles of heat exchange to control the mattress temperature.

In connection with the known methods of accomplishing temperature control, there are various problems and deficiencies that render these known methods ineffective or less than fully effective at achieving temperature control under optimal conditions. For example, such systems, particularly those that are designed for cooling, can be fairly noisy, thereby interfering with the subject individual's ability to sleep and defeating many of the therapeutic aspects of such systems.

Of somewhat more universal importance, however, is the lack of specificity such systems have in controlling temperatures in various zones of coverage, when the user desires different temperatures in different zones. A user that desires a particular temperature for sleeping may share his or her bed with another person who desires a different temperature for sleeping—a situation that may lead to arguments, one user's lack of comfort, or a compromise that leaves neither partner happy. Another user may desire, for example, a certain temperature for the majority of his or her body but a somewhat warmer temperature for his or her feet, or a somewhat cooler temperature for his or her head.

In order to satisfy the need for multiple zones, conventional systems have heretofore utilized multiple apparatuses to conduct zone-independent temperature modulations. In the situation where the bed is to be shared, each side of the bed may be provided with its own independent temperature control apparatus. A similar arrangement could potentially be used for different zones associated with a single user. However, conventional arrangements that require multiple independent systems require substantial duplication of the most expensive and potentially noisy parts of a conventional temperature control system—the circulation pump and the heating or cooling source.

Yet another issue with conventional single-zone systems is that they are not programmatically controllable over time. Although some systems provide for thermostatic control to prevent overheating or overcooling, some users may desire, for example, a warmer temperature at bedtime and a cooler temperature later in the sleep cycle, or vice versa. These systems are even more deficient when the user wishes to coordinate varying temperatures in various zones with various stages of the sleep cycle in order to promote deeper and more satisfying sleep.

Although many of the applications of the present invention relate to sleep and beds, the invention is equally applicable to other types of support furniture, such as chairs, or to more portable systems, such as wheelchair cushions, blankets, or mattress toppers.

What is needed is a multi-zone temperature modulation system that enables selective and independent heating or cooling of specific zones using a single heating or cooling apparatus and pump to minimize the cost efficiency of manufacture, and that may be programmatically controlled to vary the target temperature over time according to personal comfort or sleep cycle considerations.

SUMMARY OF THE INVENTION

In accordance with the aforementioned needs, the present invention includes a temperature modulation system for a bed that uses a fluid, such as a liquid or a gas, as the medium for temperature change at a surface of the bed. The fluid is directed through at least two conduit circuits that traverse respective independent zones, utilizing principles of heat exchange to heat or cool the bed surface. The invention employs a thermoelectric device to modulate the temperature of the fluid and a pump, such as a multichannel pump or a pump in combination with a multi-way valve, to pump the fluid through the conduit circuits. In this arrangement, each of the conduit circuits selectively and independently directs fluid through its respective zone to achieve a temperature of the mattress within the zone that is independent of the temperature of the mattress outside that zone.

In another feature of the present invention, a valve, which may be mechanically or electrically operated, may be used selectively to direct fluid through the various conduit circuits at different rates to produce different levels of temperature change in different zones. Such an arrangement may be flow-based, in which a given flow of fluid is divided among zones, or a time-division arrangement, in which the full flow of fluid is directed sequentially through the zones as needed to produce the target temperature of each.

In yet another feature of the invention, multiple components, such as pumps and valves, may be utilized to achieve the appropriate temperature in each of multiple zones.

The system of the present invention may produce heating alone, cooling alone, or both heating and cooling, as the user may require.

In still another feature of the invention, the system may be provided with one or more temperature sensors, which are configured to measure the temperature of the zone to provide feedback to a control mechanism in order to enable the system to reach the target temperature in each zone more efficiently.

The system of the present invention may be embedded within the mattress, or it may be portable, being embedded in a topper or blanket that is designed to be placed over the mattress.

The system may be conveniently controlled by remote control, and when the system is integrated with the mattress, the remote control may be likewise integrated with other remotely controlled functions of the mattress, such as firmness control (for an air-based mattress), vibration control, and the like.

In another feature of the invention, the system is provided with a port connected to the constituent components (or to an internal control mechanism for those components) that enables the system to be connected to a computer for programmatic control of the operation of the system.

Alternatively, the present invention includes a multi-zone temperature modulation system for providing selective temperature change to a living subject. The system includes first and second independent zones, each of which has a conduit circuit for directing fluid through the zone in order to bring that zone's temperature to a target temperature. As above, a thermoelectric device selectively modulates the temperature of the fluids, at least one pump is used to pump the fluids through the conduit circuits. The fluid associated with one zone may be isolated from fluid associated with the other zone, or those fluids may be pooled. The system may employ separate pumps for separate conduits, or it may employ a single pump, aided by a multi-outlet valve or other valve types that permit separate flow to different circuits.

The present invention also alternatively includes a temperature modulation system for providing selective temperature change to a living subject on a time-based programmatic basis. As above, the system includes a fluid for moderating temperature change within a selected zone adjacent the subject, and a conduit circuit for directing the fluid through the selected zone according to a selected target temperature. A thermoelectric device handles the heating or cooling, and a pump is used to pump the fluid through the conduit circuit.

This alternative system also utilizes control means, such as a general-purpose or special-purpose computer that has been programmed, to control operation. The control means may be programmed to control the zone temperature according to a schedule of target temperatures over a selected period of time.

Similar features to those described in connection with the embodiment described first above may be utilized in the alternative systems.

BRIEF DESCRIPTION OF THE DRAWINGS

Further features, embodiments, and advantages of the present invention will become apparent from the following detailed description with reference to the drawings, wherein.

DETAILED DESCRIPTION OF THE PREFERRED EMBODIMENTS

Figure 1:
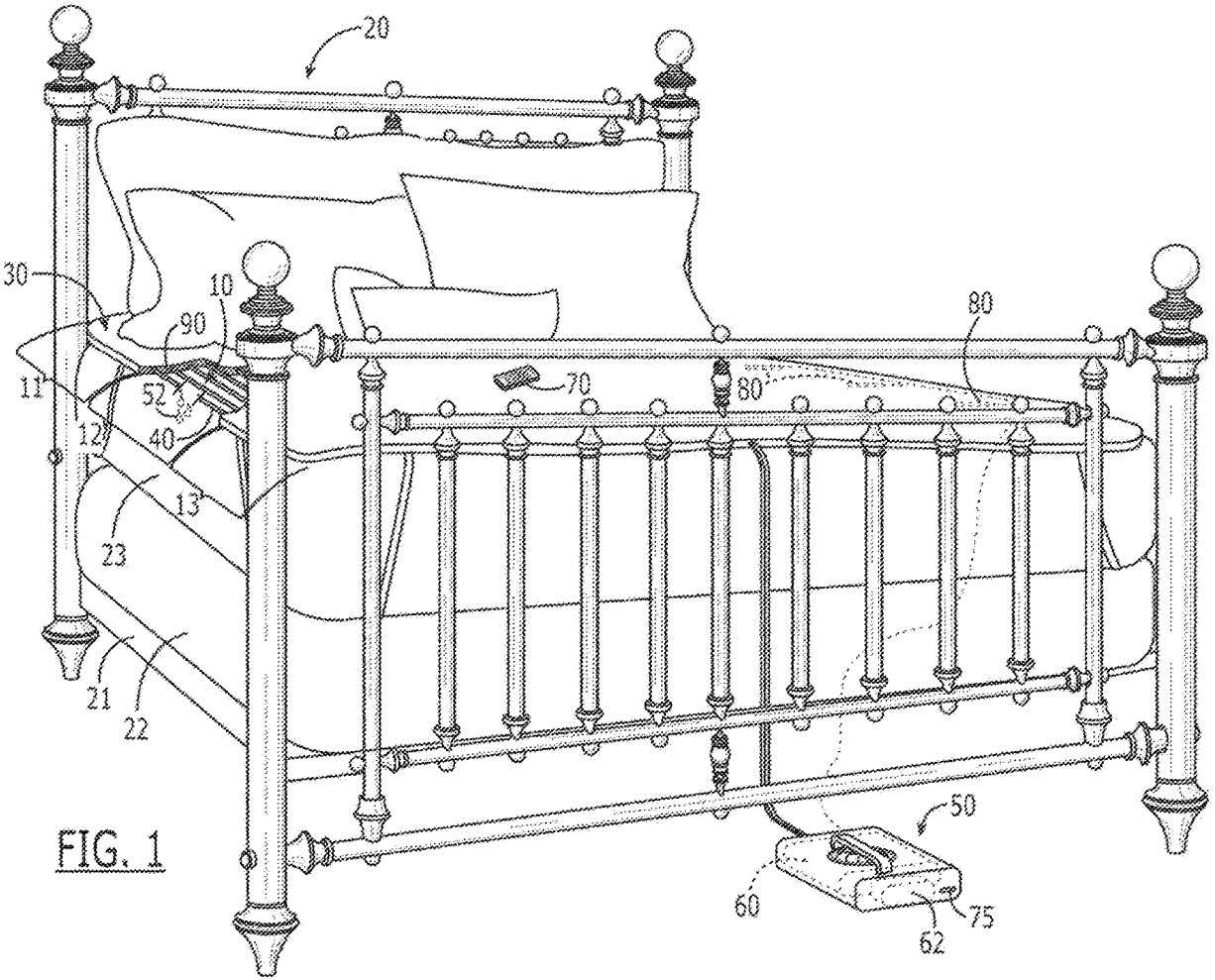
FIG. 1 is an environmental view of a preferred embodiment of the present invention.

Referring now to the drawings, FIG. 1 illustrates the general arrangement of a preferred embodiment of a multi-zone temperature modulation system 10 according to the present invention in an environmental perspective view. A bed 20 includes a support frame 21, a box spring foundation 22, and a mattress 23, all of conventional construction. In the depicted embodiment, the mattress 23 has been provided with a topper 30 that has embedded within it a multi-zone temperature modulation system 10 according to the present invention. Although the depicted embodiment illustrates a separate mattress topper 30, those skilled in the art will recognize that it is equally possible to combine the mattress 23 and topper 30 into a single piece, with the temperature modulation system 10 effectively being embedded in the mattress 23 itself. A separate mattress topper 30 may hold some advantages over the combined construction because of the ability to use a separate topper 30 to retrofit an existing mattress 23.

The system 10 as depicted is divided generally into three temperature zones 11,12,13, which correspond generally to the position of a person's head and neck, trunk and legs, and feet when the person (not shown) lies on the mattress 23. The depicted system 10 is arranged to permit the three zones 11,12,13 to be targeted for three independent temperatures. As used herein, the term "independent temperature" refers to a zone temperature that is set or targeted without respect to the temperature of another zone; an independent temperature may be the same temperature as that of another zone, and there is no requirement that the temperatures be different.

Although the embodiment depicted in FIG. 1 shows multiple zones arranged for a single person's use, other multi-zone arrangements are possible, and will be discussed in greater detail below. The present invention is not limited to a particular number or arrangement of the zones; it is sufficient for the multi-zone aspect of this invention that there be more than one zone, regardless of the disposition of the zones.

In order to accomplish the temperature modulation of the zones 11,12,13, a set of conduit circuits 40, at least one per zone, is provided. These conduit circuits 40 may be formed of any suitable material, such as plastic or metal, or more preferably flexible silicone, selected with the principal consideration being the ability of the conduit circuit material to transmit heat to or from the topper 30. Depending on the configuration of the zone, it may be preferred to have more than one conduit circuit 40 per zone, particularly in the case of a very large zone. The conduit circuit or circuits 40 repeatedly traverse the zone in a back-and-forth arrangement, in order to provide temperature modulation to the entire desired surface area of the zone. The conduit circuits 40 are arranged to return to their starting point to enable the return of fluid to the heating/cooling apparatus 50.

The heating/cooling apparatus 50 generally includes one or more reservoirs 60 for temperature modulation fluid 52, which may be a liquid, such as water, or a gas. In a preferred embodiment shown, water is the fluid mediator for temperature modulation. The reservoir 60 is provided with a device 62 for heating or cooling the liquid 52 stored therein, such as a Peltier thermoelectric device. Such a device is generally well known and useful for its efficient movement of heat when a direct current is applied thereacross. The Peltier device 62 creates a heat source and a heat sink on its opposite sides, and if the direction of the current applied across it is reversed, the heat source and heat sink switch sides. This feature makes a Peltier device 62 ideal for systems which require selective heating and cooling.

The Peltier device 62 is thus used to change the temperature of the reservoir fluid 52, i.e. heating or cooling the fluid 52 in order to heat or cool the zones 11,12,13, according to the position of a switch that is under one of various forms of control to be discussed in more detail below. In response to a need for heating or cooling a zone, fluid is drawn from the reservoir 60 and directed through the conduit circuits 40 to effectuate the necessary temperature change. The application of energy necessary to move the fluid 52 through the conduit circuits 40 is effectuated in a variety of possible ways, such as through the use of a multichannel pump, multiple single-outlet pumps, or a single-outlet pump in combination with one or more valves.

Control 70, which is wireless as shown but which may alternatively be provided with a wired connection to the heating/cooling apparatus 50, is used to set the target temperatures for each of the zones. Control 70 in combination with temperature probes 80 will enable the system to maintain a target temperature in each zone 11,12,13 through the selective application of heated or cooled fluid to the conduit circuits 40 in each zone. Using the control 70, a user will select an independent target temperature for each zone 11,12,13. Temperature probes 80 in each zone will provide temperature data for that zone to the heating/cooling apparatus 50, which will by comparison of the target temperature set using the control 70 and the actual measured temperature determine whether to heat or cool the fluid 52 and determine to which conduit circuit or circuits 40 the heated or cooled fluid 52 should be distributed in order to make the actual temperature match the target temperature.

In a preferred embodiment, the topper 30 or mattress 23 (for embedded designs) will include padding 90 between the conduit circuits 40 and the resting surface, in order to improve the comfort of a user who lies upon the system and to prevent the concentrated heat or cold of the conduit circuits 40 from being applied directly or semi-directly to the user's body. Instead, the conduit circuits 40 will heat or cool the padding 90, which will provide more gentle temperature modulation for the user's body.

Figure 2A:
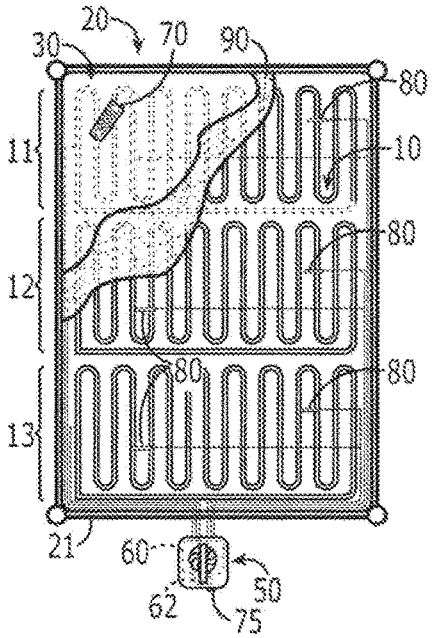
FIG. 2A is a plan view of a preferred embodiment as in FIG. 1.
Figure 2B:
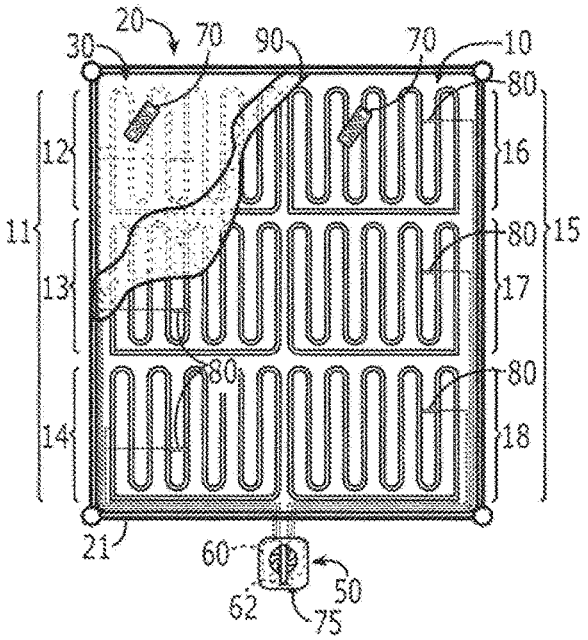
FIG. 2B is a plan view of an alternative embodiment.
Figure 2C:
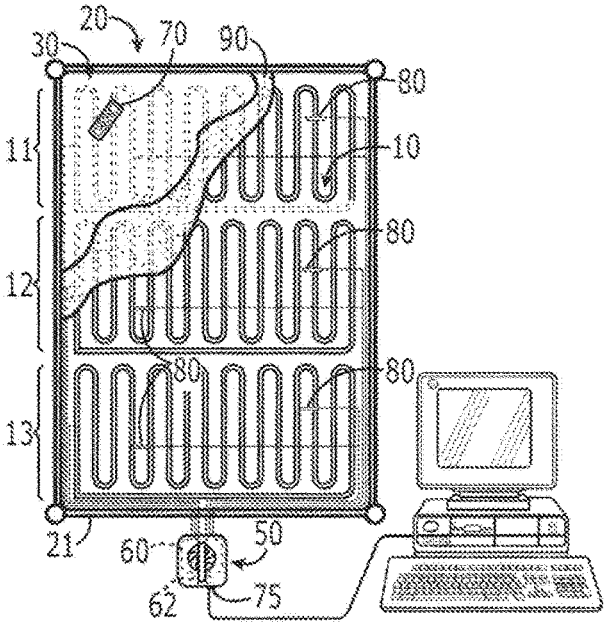
FIG. 2C is a plan view of another alternative embodiment.

Referring now to FIGS. 2A-2C, various embodiments of the present invention are illustrated in plan view for comparative purposes, in order to demonstrate the various zone arrangements that may be serviced according to the present invention. In FIG. 2A, the view is as in FIG. 1, in which three zones 11,12,13, corresponding generally to the head, body and legs, and feet, respectively, of the subject utilizing the system. Although only three zones are shown, it is equally possible to have two, four, or more zones of control. In FIG. 2B, another preferred embodiment is shown in which two sides of a two-person bed, such as a full, queen, or king size bed, are provided with two separate zones 11,15. These zones may themselves be divided into zones or subzones 12,13,14 and 16,17,18 as in FIG. 2A. In the arrangement shown in FIG. 2B, two separate controls may be provided in order to enable each user to set his or her own preferences. In this embodiment, despite the presence of two separate controls, a single heating/cooling apparatus 50 may be utilized to control the temperature of reservoir fluid 52.

In FIG. 2C, another alternative embodiment is shown in which, again, there are three zones 11,12,13. For purposes of this embodiment, the arrangement could as easily encompass only a single zone 11, because the significance of this embodiment is in the control system 71. Instead of a wireless handheld control, the heating/cooling apparatus 50 may be conveniently connected via a port 75 such as a USB, serial, or other port to computer 71. Computer 71 has been programmed to control the operation of the system 10 in accordance with a schedule of target temperatures selected to correlate with sleep cycles of the user. Such an arrangement may promote deeper, more restful sleep by altering body temperature at critical points. This arrangement will be discussed in greater detail below.

Figure 3:
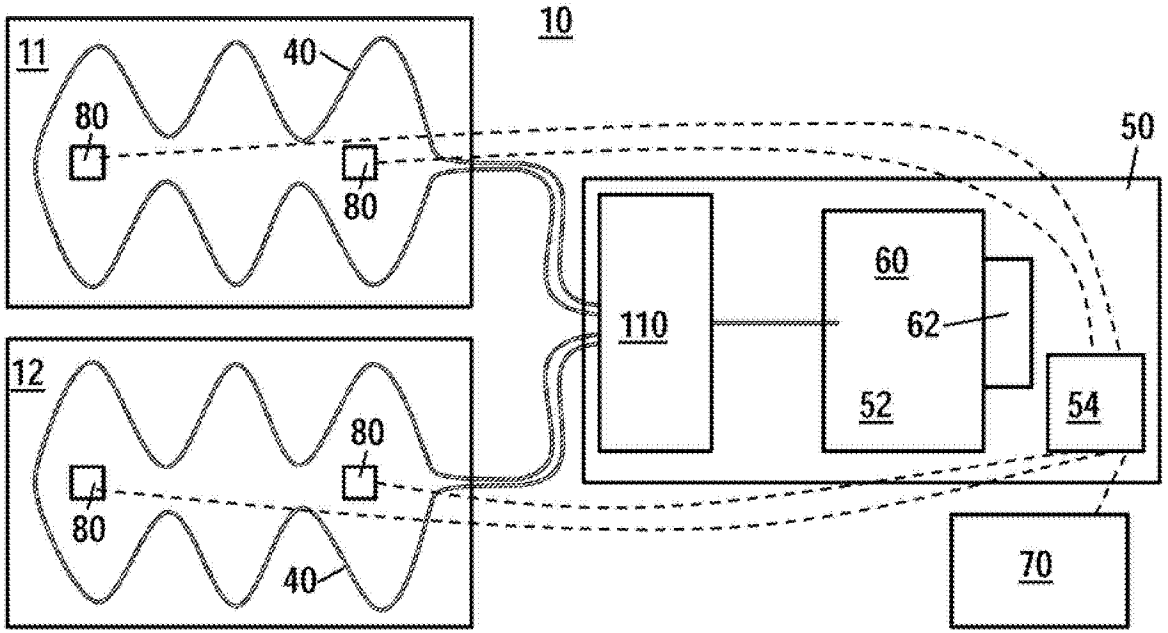
FIG. 3 is a schematic view of a preferred embodiment of the present invention.

Referring now to FIG. 3, a preferred embodiment of the present invention is shown in a schematic view to illustrate in greater and more convenient detail the various components of the system. Zones 11,12 are provided with conduit circuits 40 for directing a heated or cooled fluid 52 therethrough. The fluid 52 is held in a reservoir 60 and heated or cooled using a Peltier device 62 or any other suitable means. Temperature probes 80 are located within the zones 11,12 and are connected to the control unit 50, which contains computing apparatus 54, which may be a microprocessor, a circuit board containing logic circuits, or any other suitable arrangement, the construction of which is well known in the art to which the present invention relates. Computing apparatus 54 is attached to a user interface 70, which may in various embodiments be a handheld wireless or wired remote control, a personal computer, or other suitable input device. The user interface 70 may be used to set the parameters of operation of the control unit 50.

The computing apparatus 54 is designed or programmed to operate the Peltier device 62 and more particularly to apply direct current of a given polarity across the Peltier device 62, in order to heat or cool the fluid 52 in the reservoir 60, as needed. The computing apparatus 54 is also designed or programmed to operate a pump and valve system 110, various embodiments of which are illustrated in schematic detail in FIGS. 4A-4C. By manipulating the pump and valve system 110, the computing apparatus may control the manner in which heated or cooled fluid 52 is driven through the conduit circuits 40 to heat or cool the zones 11,12.

For example, in the beginning of use, a user, using the user interface 70, may call for a target temperature of 60° F. in zone 11 and a target temperature of 70° F. in zone 12. The temperature probes 80 may register the temperature of zone 11 as 75° F. in zone 11 and 74° F. in zone 12. The computing apparatus 54 therefore activates the Peltier device 62 in cooling mode, to chill the reservoir fluid below 60° F. The computing apparatus 54 also activates the pump and valve system 110, causing fluid 52 to flow through both conduit circuits 40, back and forth across the two zones 11,12, and returning to the reservoir 60. Over time, the actual temperature as measured by the temperature probes 80 decreases. At a given point, the temperature in zone 12 may be measured at the target of 70° F. The computing apparatus 54 then controls the pump and valve system 110 to cause cooled fluid to stop flowing through zone 12, even as cooled fluid continues to flow through zone 11. Eventually, the temperature in zone 11 will also reach the target. However, because the temperature in zone 12 may rise, the pump and valve system may be adjusted one or more times during the process to maintain the temperature in zone 12 at the target, while the temperature in zone 11 continues to drop to the lower target temperature.

Those skilled in the art will recognize that programmatic control of the target temperatures over time, such as over the course of a night's sleep, will be possible if a computer 70 is employed as the user interface. Because the target temperatures may be set at any time, those target temperatures may be manipulated through the sleeping period in order to match user preferences or a program to correlate with user sleep cycles to produce a deeper, more restful sleep.

In the system heretofore described, the details of the pump and valve system 110 have been largely omitted. A system 110 according to the present invention will permit the elimination of duplicate parts, typically the most expensive parts of such an apparatus, such as the heating/cooling device 62 and the control apparatus 54, through the creative use of one or more pumps and valves and principles of time and flow division.

Figure 4A:
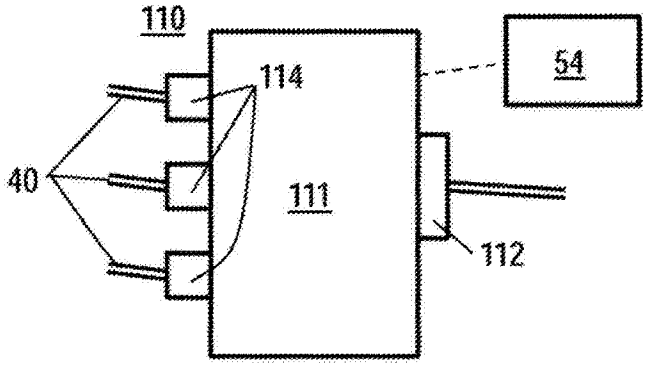
FIGS. 4A-4C are schematic detail views of alternative preferred embodiments of a pump arrangement according to the present invention.

Referring now to FIG. 4A, a first preferred embodiment of a pump and valve system 110 is a multichannel pump 110 which includes an inlet 112 which serves as a conduit for fluid from the reservoir 60 and a number of outlets 114, each of which may be independently controlled to permit fluid 52 to flow or not to flow into a respective conduit circuit 40 associated with a zone 11,12,13. In this arrangement, the multichannel pump 110 applies pressure to the fluid 52 and selectively opens each outlet 114 according to instructions from a control apparatus 54 (see FIG. 3) to allow fluid to flow to the associated zone 11,12,13, thus cooling or heating the zone 11,12,13 in accordance with a differential between the target temperature and the actual temperature for that zone. Because the outlets 114 are individually controlled, the flow of fluid 52 may be divided among one or more outlets 114 at the same time. Alternatively, this arrangement may be used in a time-division arrangement, whereby the full flow of fluid 52 is directed serially through the respective outlets 114 in order to achieve the same effect.

Figure 4B:
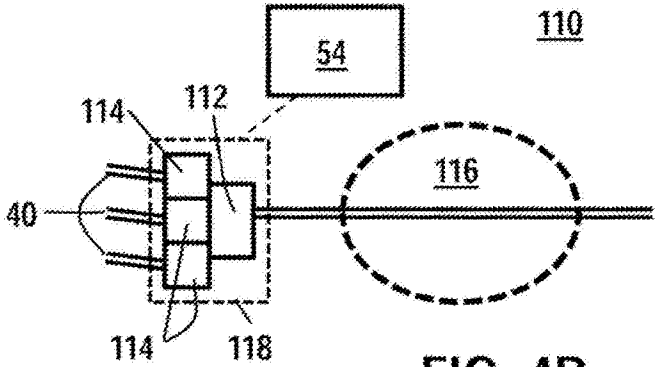

Referring now to FIG. 4B, a second preferred embodiment of a pump and valve system 110 is illustrated. This arrangement is simpler in scope than the embodiment shown in FIG. 4A, in that the pump 116 is physically separated from the valve 118. The pump 116 is activated to provide fluid pressure, and the valve 118 is under the control of the control apparatus 54, alternately directing the fluid from inlet 112 through outlets 114,114,114 serially in a time-division arrangement.

Figure 4C:
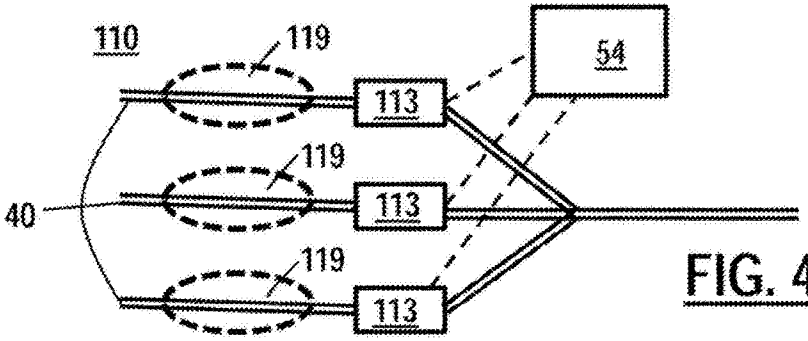

Referring now to FIG. 4C, another preferred embodiment of a pump and valve system 110 is illustrated. In this arrangement, each zone 11,12,13 is provided with its own pump 110 and valve 113, which independently operates to provide fluid pressure through the associated conduit circuit 40. This arrangement results in some duplication of components, but may be useful under certain circumstances in which there is a need to provide full flow of fluid 52 through each zone 11,12,13 at all times.

The principle of time division, as applied in the present invention, relies upon the tendency of the temperature of a given zone to remain fairly steady over time. That is, heating or cooling might need only be applied for a few minutes per hour to keep the temperature of a given zone at the target, while another zone may require fairly constant heating or cooling to maintain its target temperature. The control apparatus 54 may thus divide the time among the zones in an efficient manner that keeps each zone as near to its target temperature as possible over the greatest period of time.

Figure 5A:
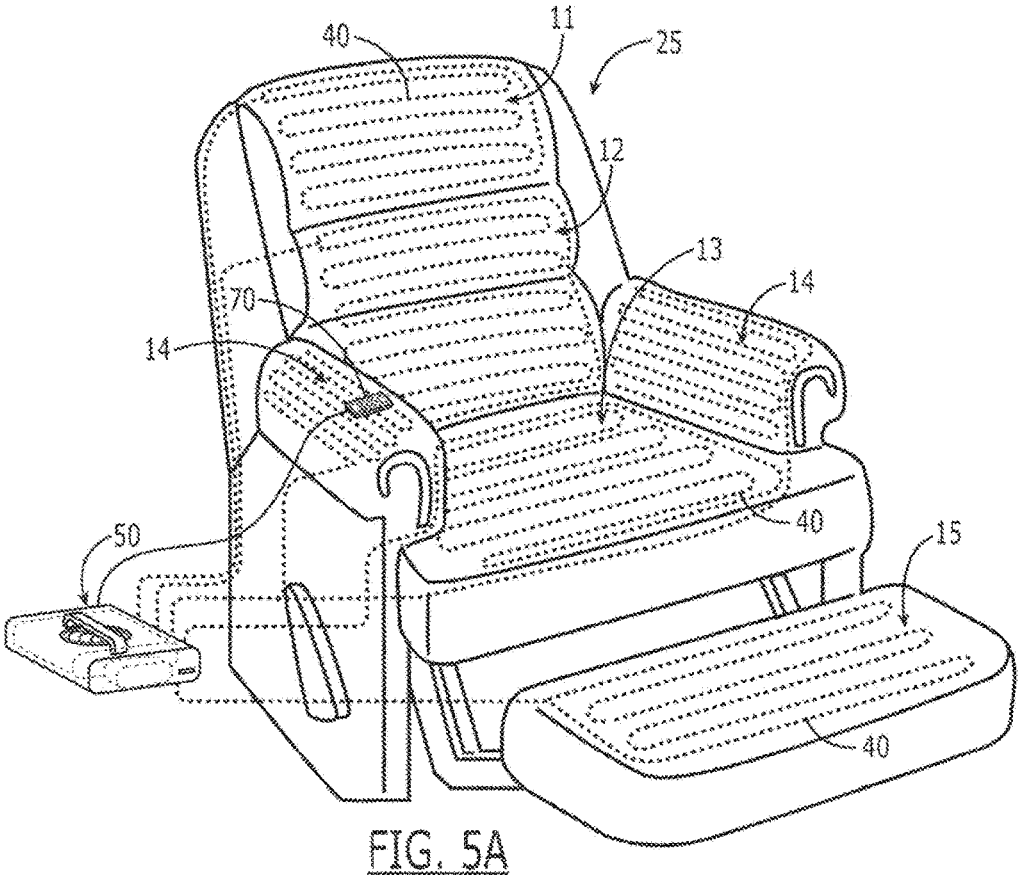
FIGS. 5A-5B are environmental views of alternative embodiments of the invention.

Although the arrangement illustrated in FIGS. 1 and 2A-2C is in a mattress-type arrangement, such as a mattress 23 or a topper 30, it is equally possible to apply the concepts of the invention to other contexts. For example, as in FIG. 5A, a recliner chair 25 is shown. In much the same manner as is done with the mattress 23 or topper 30 arrangements, the recliner chair 25 is provided with a number of zones 11,12,13,14,15, each of which has an associated conduit circuit 40 under independent temperature control by a control apparatus 50 as directed by a user interface 70. The operation of such a system is identical to that described above.

Figure 5B:
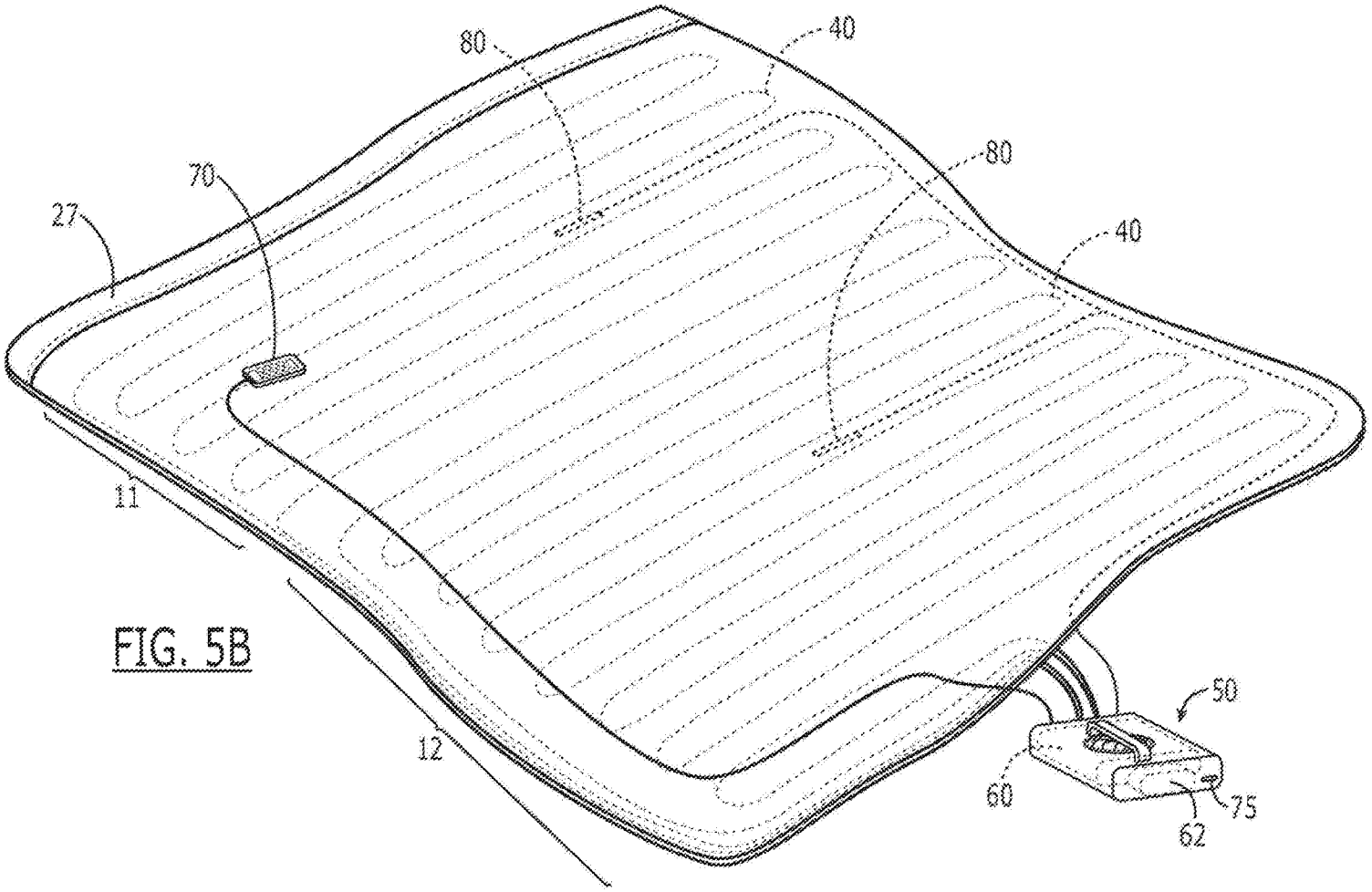

Also, as is illustrated in FIG. 5B, the concepts of the present invention are not limited to support furniture such as mattresses, chairs, and the like. A multi-zone heating/cooling system may be contained within a blanket 27, for example, which may be conveniently placed over or under the user to provide heating or cooling within given zones 11,12. In such an arrangement, the use of flexible tubing for the conduit circuits 40 is important to promote the ability of the blanket 27 to conform to the user's body.

Referring now to the drawings generally, a temperature modulation system 10 for a bed 20 includes a fluid 52 for moderating temperature change at a surface 24 of the bed 20, a number of conduit circuits 40 for directing the fluid 52 through respective zones 11,12,13, and a thermoelectric device 62 for modulating the temperature of the fluid 52. The system 10 also includes a pump 110 for pumping the fluid 52 through the conduit circuits 40. Each of the conduit circuits 40 selectively, by use of a pump and valve system 110, and independently directs fluid 52 through its respective zone 11,12,13 to achieve a temperature of the mattress 23 of the bed 20 that is independent of the temperature of the bed 20 outside the zone 11,12,13.

The fluid 52 may be a liquid such as water, or it may be a gas such as air, depending upon the requirements of the system. The pump and valve system 110 may be a multichannel pump, or it may be a single pump with a multi-outlet valve, or it may include several pumps and valves. The particular type of pump and valve system chosen may be tied to the nature of the fluid 52. The valves 113 may be mechanically or electrically operated, under the control of a control system 54 that selectively opens and closes the valves 113 to permit fluid 52 to flow therethrough.

The system 10 may be designed to operate on a flow-division or a time-division basis, the latter being characterized by permitting the full flow of fluid 52 to be directed through a single conduit circuit 40 for a given period of time, one at a time serially, to achieve the target temperature in each zone 11,12,13.

In order that the system 10 may control each zone individually, temperature sensing probes 80 are provided, which give feedback to the control system 54 concerning the actual temperature of the given zone 11,12,13.

Through the use of a Peltier thermoelectric device 62, it is possible to provide heating and cooling using the same unit, thereby increasing the utility of the present invention in comparison to systems that provide only heating or only cooling.

In the context of bed use, the system 10 may be integrated into the mattress 23, or it may be a separate article such as a mattress topper 30.

The system 10 may conveniently receive user input through a user interface 70 such as a remote control, wired or wireless. Alternatively, the system may be provided with a port 75 to connect it to a computer 71 such as a personal computer, in order to enable programmatic control of the system over time.

More generally, the present invention includes a multi-zone temperature modulation system 10 for providing selective temperature change to a living subject. The system includes a first zone 11 that includes a first conduit circuit 40 for directing a first fluid 52 therethrough, in order to bring the first zone temperature to a target temperature for the first zone. The system also includes a second zone 12 of similar but independent construction, and the second zone 12 has a target temperature that is independent of the target temperature of the first zone 11. As above, this embodiment uses a thermoelectric device for selectively modulating the temperature of the first and second fluids, as well as at least one pump for pumping the fluids through the conduit circuits. Similar features of this embodiment are provided as above.

This arrangement is applicable to a wide variety of contexts, including beds, mattress toppers, chairs, other support furniture, and blankets.

Yet another embodiment involves the use of at least one zone and the selective manipulation of the temperature over a period of time. In such an embodiment, a temperature modulation system 10 provides selective temperature change to a living subject and includes a fluid 52 for moderating temperature change within a selected zone 11 adjacent the subject. At least one conduit circuit directs the fluid 52 through the zone 11 to control temperature of the zone 11 according to a selected target temperature. The structure is largely as above, but the control system 54 (either on its own or under the programmatic control of an attached computer 71) is programmed to control the zone temperature according to a schedule of target temperatures over a selected period of time.

In view of the aforesaid written description of the present invention, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise to exclude any such other embodiments, adaptations, variations, modifications and equivalent arrangements, the present invention being limited only by any claims appended hereto and the equivalents thereof.

What is claimed is:

1. A system for temperature-conditioning a surface comprising:

an upper layer;

a lower layer;

at least two conduit circuits for directing water through at least two independent temperature zones, wherein the at least two conduit circuits are positioned between the upper layer and the lower layer;

padding positioned between the upper layer and the at least two conduit circuits;

a control unit to selectively heat or cool the water, wherein the control unit consists of one control unit;

wherein the at least two conduit circuits include a first conduit circuit and a second conduit circuit;

wherein the at least two independent temperature zones include a first independent temperature zone and a second independent temperature zone, wherein the first independent temperature zone includes the first conduit circuit and at least one first temperature sensor physically located within the first independent temperature zone operable to measure an actual temperature of the first independent temperature zone, wherein the at least one first temperature sensor is surrounded by the first conduit circuit, and wherein the second independent temperature zone includes the second conduit circuit and at least one second temperature sensor physically located within the second independent temperature zone operable to measure an actual temperature of the second independent temperature zone, wherein the at least one second temperature sensor is surrounded by the second conduit circuit;

wherein the one control unit includes a pump for pumping the water through the at least two conduit circuits, wherein the pump consists of one pump, wherein the one pump includes a first inlet, a second inlet, a first outlet, and a second outlet, wherein the at least two conduit circuits include a first conduit circuit and a second conduit circuit, and wherein a first end of the first conduit circuit is connected to the first outlet of the one pump, a second end of the first conduit circuit is connected to the first inlet of the one pump, a first end of the second conduit circuit is connected to the second outlet of the one pump, and a second end of the second conduit circuit is connected to the second inlet of the one pump;

wherein the one control unit includes a reservoir provided with a thermoelectric device, wherein the reservoir consists of one reservoir, and wherein the thermoelectric device consists of one thermoelectric device operable to provide heating and cooling for the one reservoir;

wherein the at least two conduit circuits are comprised of silicone;

wherein the at least one first temperature sensor is connected to the one control unit and provides the actual temperature of the first independent temperature zone to the one control unit;

wherein the at least one second temperature sensor is connected to the one control unit and provides the actual temperature of the second independent temperature zone to the one control unit;

wherein the one control unit is operable to simultaneously control the flow of the water to the at least two independent temperature zones through the first outlet of the one pump and the second outlet of the one pump or control the flow of the water to the at least two independent temperature zones sequentially through the first outlet of the one pump and the second outlet of the one pump;

wherein the one control unit is operable to maintain a target temperature of the first independent temperature zone and the second independent temperature zone via the simultaneous control or the sequential control of the flow of the water;

wherein the simultaneous control or the sequential control of the flow of the water is governed based on scheduled target temperatures correlating to a sleep cycle of at least one user; and wherein the at least two independent temperature zones are embedded between the upper layer and the lower layer.

2. The system of claim 1, wherein the one control unit is operable to receive commands from at least one wireless device.

3. The system of claim 1, wherein the one thermoelectric device consists of one Peltier device operable to provide heating and cooling for the one reservoir.

4. The system of claim 1, wherein one or more of the at least two independent temperature zones further comprises at least two independent temperature subzones.

5. The system of claim 1, wherein the one control unit is operable to selectively control temperature of the water in the first independent temperature zone by the one thermoelectric device heating or cooling the water in the one reservoir, the one pump pumping the heated or cooled water through the first conduit circuit, the at least one first temperature sensor measuring the actual temperature of the first independent temperature zone and providing the measured actual temperature of the first independent temperature zone to the one control unit, the one control unit comparing the measured actual temperature of the first independent temperature zone to a target temperature for the first independent temperature zone, and the one thermoelectric device further modulating the temperature of the water in the one reservoir based on the comparison of the measured actual temperature of the first independent temperature zone to the target temperature for the first independent temperature zone.

6. The system of claim 1, further comprising at least one valve connected to the one pump, wherein the one control unit is operable to selectively control temperature of the water in the second independent temperature zone by the one pump pumping the heated or cooled water through the second conduit circuit, the at least one second temperature sensor measuring the actual temperature of the second independent temperature zone and providing the measured actual temperature of the second independent temperature zone to the one control unit, the one control unit comparing the measured actual temperature of the second independent temperature zone to a target temperature for the second independent temperature zone, and the one control unit controlling the pressure of the heated or cooled water passing through the at least one valve based on the comparison of the measured actual temperature of the second independent temperature zone to the target temperature for the second independent temperature zone.

7. The system of claim 1, wherein the first end of the first conduit circuit is connected to the one pump via at least one valve, and wherein the at least one valve is a multi-outlet valve.

8. The system of claim 1, wherein the actual temperature of the second independent temperature zone is automatically adjusted when the actual temperature of the first independent temperature zone is adjusted.

9. A system for providing selective temperature change comprising:

a surface layer;

at least two independent temperature zones positioned beneath the surface layer;

water for moderating temperature change within a selected zone of the at least two independent temperature zones;

at least two conduit circuits for directing the water through the selected zone;

a pump for pumping the water through the at least two conduit circuits;

wherein the pump consists of one pump and includes at least one inlet and at least one outlet;

a control unit to selectively heat or cool the water, wherein the control unit consists of one control unit;

a computing apparatus to control the delivery of the water through the at least two conduit circuits; and at least one remote computing device;

wherein the one control unit includes a thermoelectric device, wherein the thermoelectric device consists of one Peltier device;

wherein the at least two conduit circuits include a first conduit circuit and a second conduit circuit;

wherein the at least two independent temperature zones include a first independent temperature zone and a second independent temperature zone, wherein the first independent temperature zone includes the first conduit circuit and at least one first temperature sensor physically located within the first independent temperature zone operable to measure an actual temperature of the first independent temperature zone, and wherein the second independent temperature zone includes the second conduit circuit and at least one second temperature sensor physically located within the second independent temperature zone operable to measure an actual temperature of the second independent temperature zone;

wherein the at least one first temperature sensor is connected to the one control unit and provides the actual temperature of the first independent temperature zone to the one control unit;

wherein the at least one second temperature sensor is connected to the one control unit and provides the actual temperature of the second independent temperature zone to the one control unit;

wherein the at least one remote computing device is not housed in the one control unit;

wherein the one control unit is operable to receive commands from the at least one remote computing device;

wherein the at least one remote computing device is programmed to transmit target temperatures of at least one of the at least two independent temperature zones over a selected period of time to the one control unit; and wherein the target temperatures received by the one control unit transmitted from the at least one remote computing device simultaneously controls the flow of the water to the at least two independent temperature zones through the at least one outlet of the one pump or controls the flow of the water to the at least two independent temperature zones sequentially through the at least one outlet of the one pump.

10. The system of claim 9, wherein the target temperatures of the selected zone over the selected period of time are selected to correlate with a sleep cycle of at least one user.

11. The system of claim 9, wherein the one pump comprises a single-outlet pump in combination with one or more valves, multiple single-outlet pumps, or a multichannel pump, wherein the one pump is activated by the computing apparatus.

12. The system of claim 9, wherein one or more of the at least two independent temperature zones further comprises at least two independent temperature subzones.

13. The system of claim 9, wherein the one Peltier device is operable to adjust the actual temperature of the first independent temperature zone by heating or cooling the water in a reservoir consisting of one reservoir and the one pump pumping the water through the first conduit circuit, and wherein the one Peltier device is operable to adjust the actual temperature of the second independent temperature zone by heating or cooling the water in the one reservoir and the one pump pumping the water through the second conduit circuit, wherein the adjustment to the actual temperature of the first independent temperature zone and the adjustment to the actual temperature of the second independent temperature zone is performed simultaneously.

* * * * *